US006915608B2

(12) United States Patent
Labarre

(10) Patent No.: US 6,915,608 B2
(45) Date of Patent: Jul. 12, 2005

(54) MOTORIZED OPERATOR FOR CASEMENT WINDOWS

(76) Inventor: André Labarre, 849 Charles Guimond, Boucherville, Quebec (CA), J4B 3Z4

( * ) Notice: Subject to any disclaimer, the term of this patent is extended or adjusted under 35 U.S.C. 154(b) by 0 days.

(21) Appl. No.: 10/270,243

(22) Filed: Oct. 15, 2002

(65) Prior Publication Data

US 2003/0172591 A1 Sep. 18, 2003

Related U.S. Application Data

(63) Continuation of application No. 09/635,781, filed on Aug. 11, 2000, now abandoned.

(51) Int. Cl.[7] ..... E05F 15/00
(52) U.S. Cl. ..... 49/140; 49/246
(58) Field of Search ..... 49/139, 140, 246, 49/247, 248, 249, 250, 253

(56) References Cited

U.S. PATENT DOCUMENTS 2,259,811 A * 10/1941 Fregeau ..... 74/89.14
3,845,585 A * 11/1974 Cecil ..... 49/139
4,553,656 A * 11/1985 Lense ..... 192/142 R
4,895,048 A * 1/1990 Key et al. ..... 74/625
5,006,766 A * 4/1991 Yuhas et al. ..... 318/53
5,313,737 A * 5/1994 Midas ..... 49/324
5,493,813 A * 2/1996 Vetter et al. ..... 49/341
5,813,171 A * 9/1998 Piltingsrud ..... 49/139
5,881,497 A * 3/1999 Borgardt ..... 49/139

* cited by examiner

*Primary Examiner*—Jerry Redman
(74) *Attorney, Agent, or Firm*—Ogilvy Renault; Robert Mitchell

(57) ABSTRACT

A motorized operator for opening and closing a window sash relative to a window frame via an arm mechanism connected to the window frame and being adapted to be installed in a cavity defined in the window frame. The operator comprises a motor, a drive axle rotated by the motor, and first and second gears in meshed engagement. The first gear is mounted on the drive axle, while the second gear is mounted to the arm mechanism such that motorized rotation of the first gear rotatably drives the second gear thereby causing the arm mechanism to pivot for opening and closing the window sash. A manual operator is adapted to disengage the first and second gears from one another while becoming engaged to the second gear for manually rotating the second gear and so manually operate the arm mechanism. The manual operator comprises a handle and a manual actuator which includes a sprocket. The manual actuator is engageable on the drive axle for selectively displacing the first gear along the drive axle and cause the latter to disengage from the second gear while the sprocket of the manual actuator becomes engaged to the second gear, whereby a rotation of the manual actuator by way of the handle causes rotation of the sprocket and of the second gear and thus also a pivot of the arm mechanism.

18 Claims, 5 Drawing Sheets

MOTORIZED OPERATOR FOR CASEMENT WINDOWS

This application is a continuation of Ser. No. 09/635,781, filed Aug. 11, 2000, now abandoned.

BACKGROUND OF THE INVENTION

1. Field of the Invention

The present invention relates to window operators and, more particularly, to window operators which may be selectively motor driven or manually driven.

2. Description of the Prior Art

There are many types of fenestration products such as windows, skylights, doors with many of such windows and skylights being generally manually operated by turning a crank mechanically connected to the pivotable unit of the window or skylight, whereby various hardware, e.g. linkages, connect the crank to the pivotable unit thereby allowing for manually opening or closing of the window or skylight. Various motorized versions of such operators have been developed such that the pivotable unit can be opened or closed by way, for instance, of an electric motor.

U.S. Pat. No. 5,006,766 issued on Apr. 9, 1991 to Yuhas et al. discloses a motorized window operator which comprises a housing containing a motor in operative engagement with a gear train having an output gear. This output gear is engaged to the drive axle of the window such that the motor will cause the drive axle to rotate to either open or close the window depending on the direction of rotation of the motor. It is also possible to manually operate the drive axle by disengaging the gear train therefrom while simultaneously cutting off power to the motor. In this patent, the conventional lever or crank is replaced by the aforementioned housing which contains the motor. When the housing is in a lower position thereof, the output gear meshes with an engagement member mounted to the window's drive axle. The housing can also be displaced such as to disengage the output gear from the engagement member while engaging the latter to a tooth provided on a head member which is fixed within the housing such that, the housing may be rotated about the axis of the drive axle, in a way similar to a conventional lever or crank, thereby resulting in the manual rotation of the drive axle. Various sensors, including a rain sensor, can be interfaced with a controller adapted to issue instructions to the electric motor for appropriate operation thereof, to allow for automatic operation of the window in accordance with prescribed environmental parameters.

U.S. Pat. No. 5,493,813 issued on Feb. 27, 1996 to Vetter et al. discloses an electric window operator which can be engaged to a handle for manual operation of the window.

U.S. Pat. No. 5,313,737 issued on May 24, 1994 to Midas teaches a motorized operator encased within a housing mounted at the front of the frame of the window and which replaces the usual crank normally mounted to the window's operator shaft. In this patent, there does not seem to be any manual override.

U.S. Pat. No. 4,553,656 issued on Nov. 19, 1985 to Lense discloses a housing containing an electric motor for causing a driven member to be rotated, the driven member being connected to the sash of the window and being adapted to cause the sash to displace such as to open or close the window. A crank arm is displaceable between active and inactive positions such that when the arm is in its inactive position, the motor may turn the driven member, whereas, when the arm is in its active position, the motor is disconnected from the driven member and the crank arm can be used to manually operate the sash. The housing in which the electric motor is lodged is mounted on the window's casement.

U.S. Pat. No. 3,845,585 issued on Nov. 5, 1974 to Cecil discloses a motor positioned in the casement of the window and adapted to cause the rotation of a vertical pivot shaft disposed adjacent to vertical hollow window jamb and connected to a hinge mechanism substantially enclosed within the hollow jamb and to which the window assembly is mounted. Therefore, the motor causes the rotation of the pivot shaft which displaces the hinge mechanism in a sweeping movement such as to pivot the window assembly between open and closed positions thereof.

U.S. Pat. No. 4,895,048 issued on Jan. 23, 1990 to Key et al. discloses a powered actuator for opening and closing convertible tops, sunroofs, windows and the like, in motor vehicles. The powered actuator has a manual override to allow the actuator to be operated by hand.

U.S. Pat. No. 2,259,811 issued on Oct. 21, 1941 to Fregeau teaches a window operator adapted to allow for windows to be manually adjusted and for their remote controlled closing using an electromagnet and associated hardware.

SUMMARY OF THE INVENTION

It is therefore an aim of the present invention to provide a novel motorized operator for casement windows.

It is also an aim of the present invention to provide a novel motorized operator for casement windows, the operator being adapted to be selectively driven by a motor or manually.

Therefore, in accordance with the present invention, there is provided a motorized operator for opening and closing a window sash relative to a window frame via an arm mechanism and being adapted to be installed in a cavity defined in the window frame, comprising motor means, a drive axle adapted to be rotated by said motor means, gear means adapted to be rotatably driven by said drive axle and to so cause the arm mechanism to pivot upon rotation of said second gear for opening and closing the window sash relative to the window frame, and a manual operator displaceable between inoperational and operational positions; said gear means being manually displaceable between first and second positions, wherein in said first position, said gear means is rotated by said motor means via said drive axle for pivoting the arm mechanism and displacing the window sash, whereas in said second position, at least part of said gear means is mechanically disconnected from said drive axle such that said part of said gear means is not rotated by said motor means, said part of said gear means being connected to said arm means, whereby with said manual operator in said operational position, said manual operator is adapted to rotate said part of said gear means for causing the arm mechanism to pivot.

BRIEF DESCRIPTION OF THE DRAWINGS

Having thus generally described the nature of the invention, reference will now be made to the accompanying drawings, showing by way of illustration a preferred embodiment thereof, and in which.

DESCRIPTION OF THE PREFERRED EMBODIMENTS

Figure 1:
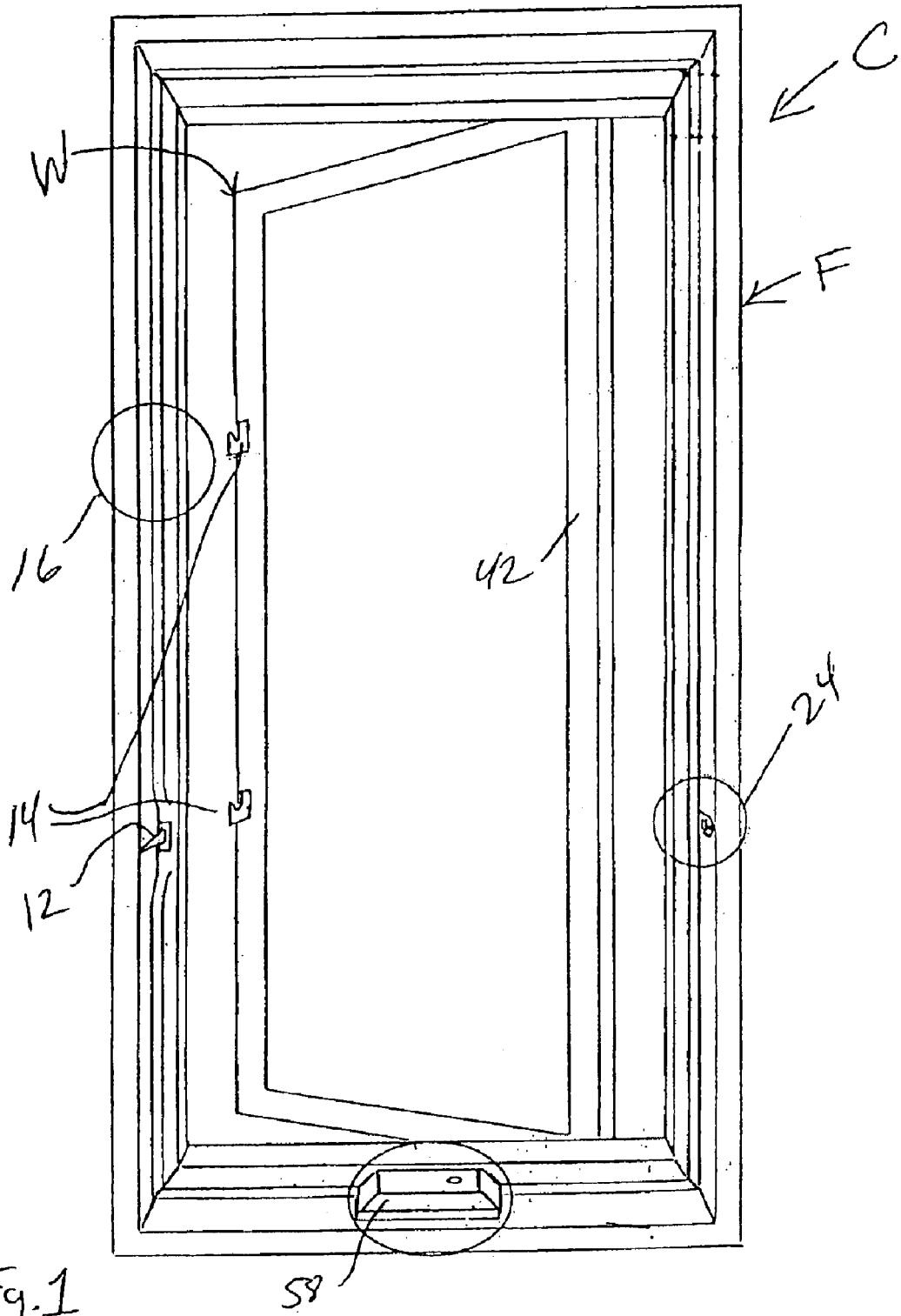
FIG. 1 is a schematic front elevational view of a casement window intended to be fitted with a motorized operator in accordance with the present invention.

FIG. 1 illustrates a casement window C generally comprised of a frame F mounted to a wall of a dwelling and a window W pivotally mounted to the frame F in a conventional manner. As it is well known in the art, a crank provided with a linkage is normally used to displace the window W between open and closed positions thereof.

Figure 2:
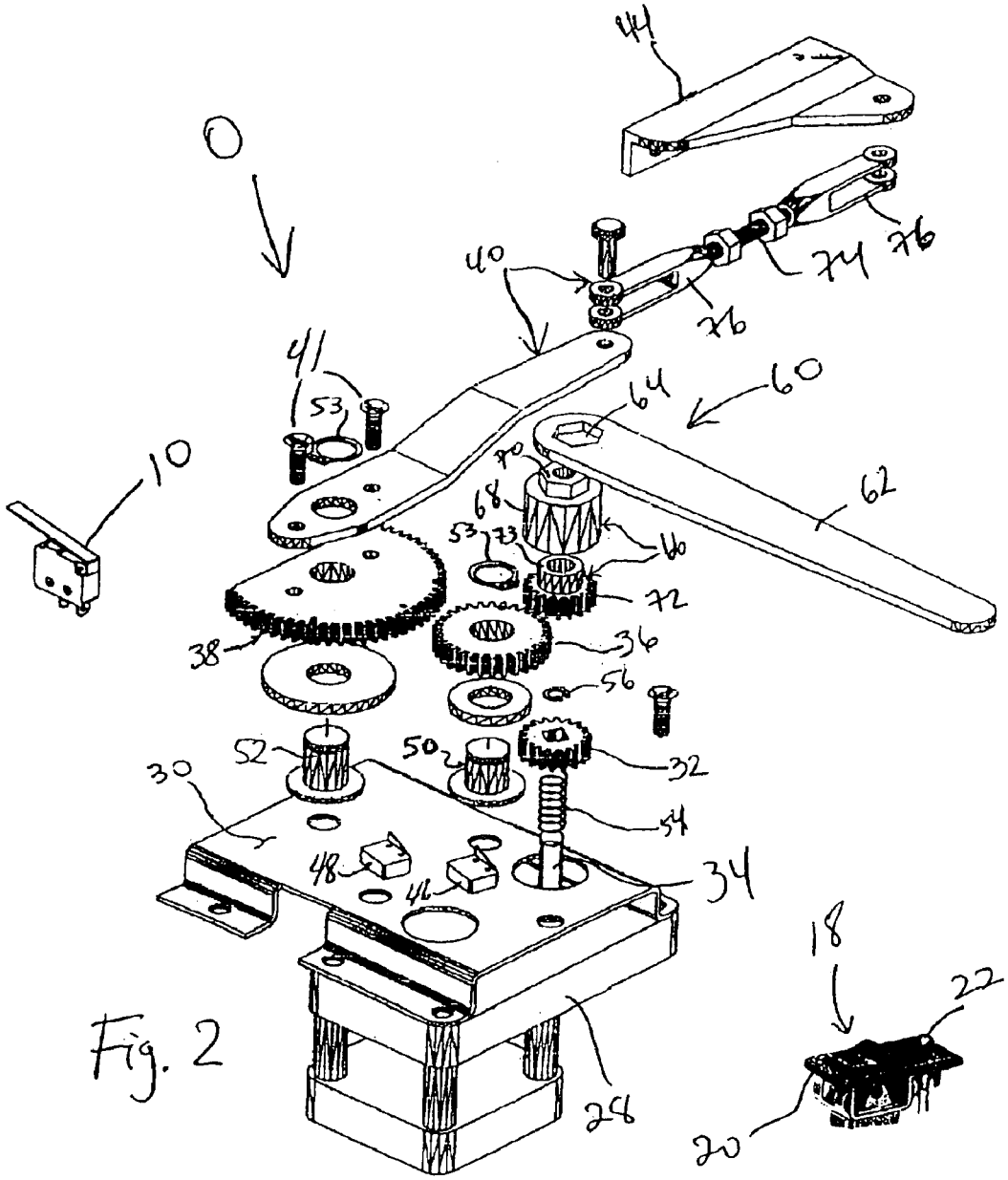
FIG. 2 is a exploded view of the motorized operator of the present invention.
Figure 3:
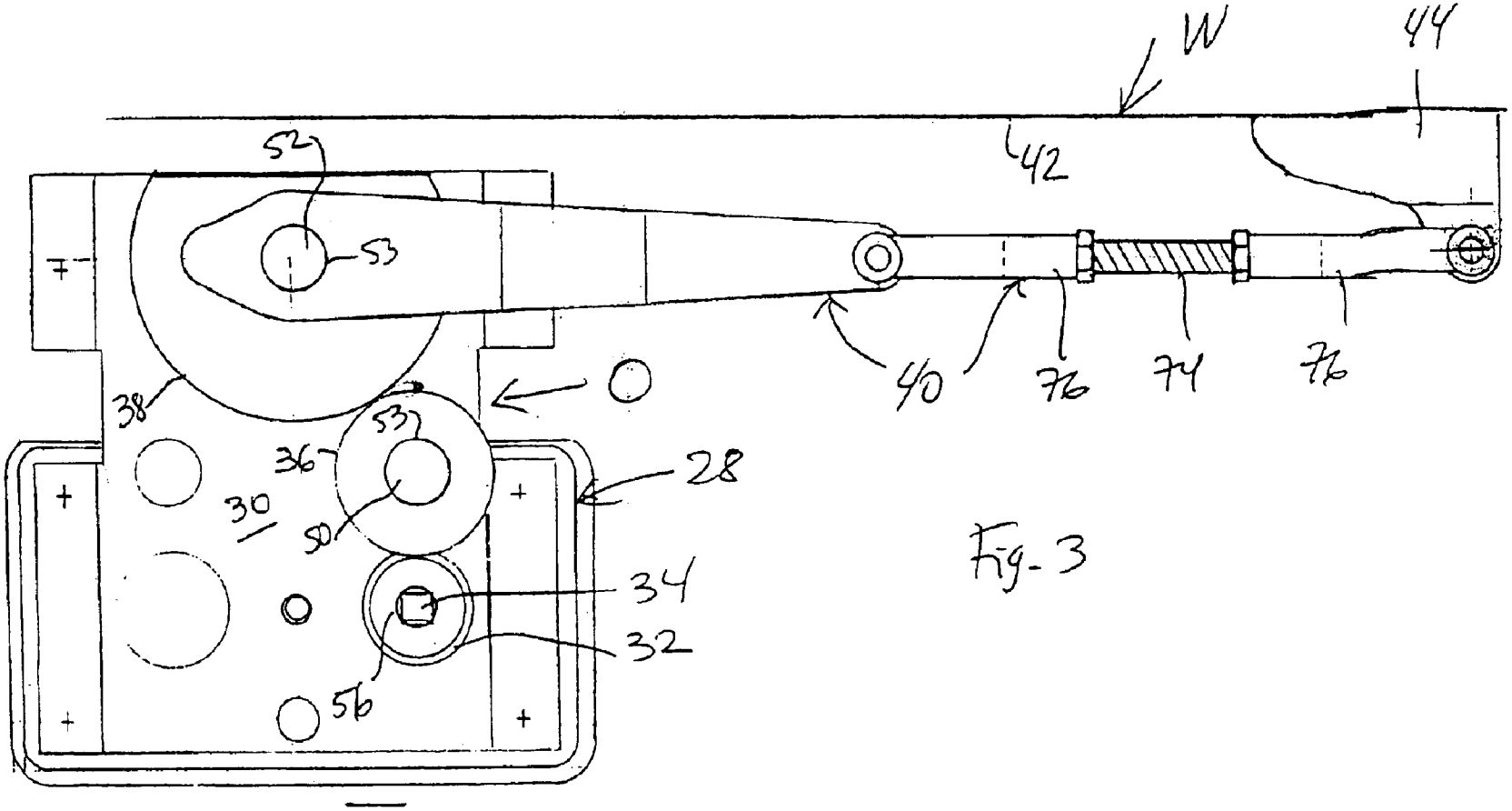
FIG. 3 is a top plan view showing the motorized operator installed on the casement window and connected to the pivotable window thereof.

Now referring to FIG. 2, there is shown an exploded view of a motorized operator O in accordance with the present invention and adapted to render the opening and closing of the window W with respect to the frame F easier, practical and safe. The motorized operator O is electrically connected to a conventional 120 volt wall outlet or may obviously be connected to a similar power supply but in a hidden fashion, that is with the wires connected to the operator O running within the wall.

It is noted that all of the components of the present motorized operator O are hidden under the moldings of the frame F, except for some subsidiary components which will be described hereinafter.

Therefore, the present motorized operator O eliminates the prior art crank arm which has a configuration which contrasts somewhat with the traditional elegance of a casement window.

Now turning to the various components of the motorized operator O illustrated in FIG. 2, a main limit switch 10 is intended to be installed under and actuated by one of the two lever catches 12 mounted within the vertical molding of the window's frame F and which co-act with hooks 14 mounted on the window W to lock the latter with respect to the frame F. The main limit switch 10 is thus adjusted such that electric power cannot be fed to the other elements of the operator O when the window W is in a locked position by way of the mating engagement of the catches 12 with their respective hooks 14. Accordingly, when the catches 12 are disengaged from the hooks 14, as shown in FIG. 1, the window W is free to be pivoted towards the open or the closed position thereof, whereby the limit switch 10 is in a position to allow power to reach the motorized operator O such that the latter can be used to displace, under motor force, the window W with respect to the frame F. In FIG. 1, the general location of the main limit switch 10 is shown at location 16. It is possible to provide a limit switch 10 for each catch 12 such as to ensure that power is fed to the operator O when both catches 12 are disengaged from the hooks 14.

A switch assembly 18 is also provided with the motorized operator O. The switch assembly 18 comprises a toggle switch 20 and a pilot light 22. When the pilot light 22 is illuminated, it indicates that the system is ready to be operated, that is that the window W can be pivoted by way of the motor force provided by the motorized operator O. This pilot light 22 can only be illuminated if the catches 12 are completely disengaged from the hooks 14, whereby it is electrically linked to the main limit switch 10. When the pilot light 22 is on, the toggle switch 20 can be actuated such as to operate the motorized operator O. For instance, by pressing the toggle switch in one direction, the window W will pivotally open, for instance, up to a maximum orientation of 55° with respect to a plane of the frame F. By pressing the toggle switch 20 in an opposite direction, the window W will close until the switch 20 is released and, for instance, until the window W is completely closed whereat the window W can then be locked by pivoting the catches 12 such that they lockingly engage the hooks 14 of the window W.

For instance, as indicated in FIG. 1, the switch assembly 18 is mounted at location 24 such that opening of the window is achieved by pressing on an upper portion of the toggle switch 20, whereas, to close the window W, a lower portion of the toggle switch 20 is depressed.

Typically, the displacement of the window W is relatively slow, for instance 10 seconds to completely close the window W from a completely open position thereof, and this permits for an easy adjustment of the window W to a desired intermediate position thereof with respect to the frame F. The toggle switch 20 is biased towards a neutral position thereof such that the window W can only be displaced once force is manually applied on either the upper or lower portions of the toggle switch 20, whereby once released, the toggle switch 20 returns to its neutral position, that is to an unoperational position such that no movement whatsoever is imparted to the window W by way of the motorized operator O.

Figure 4:
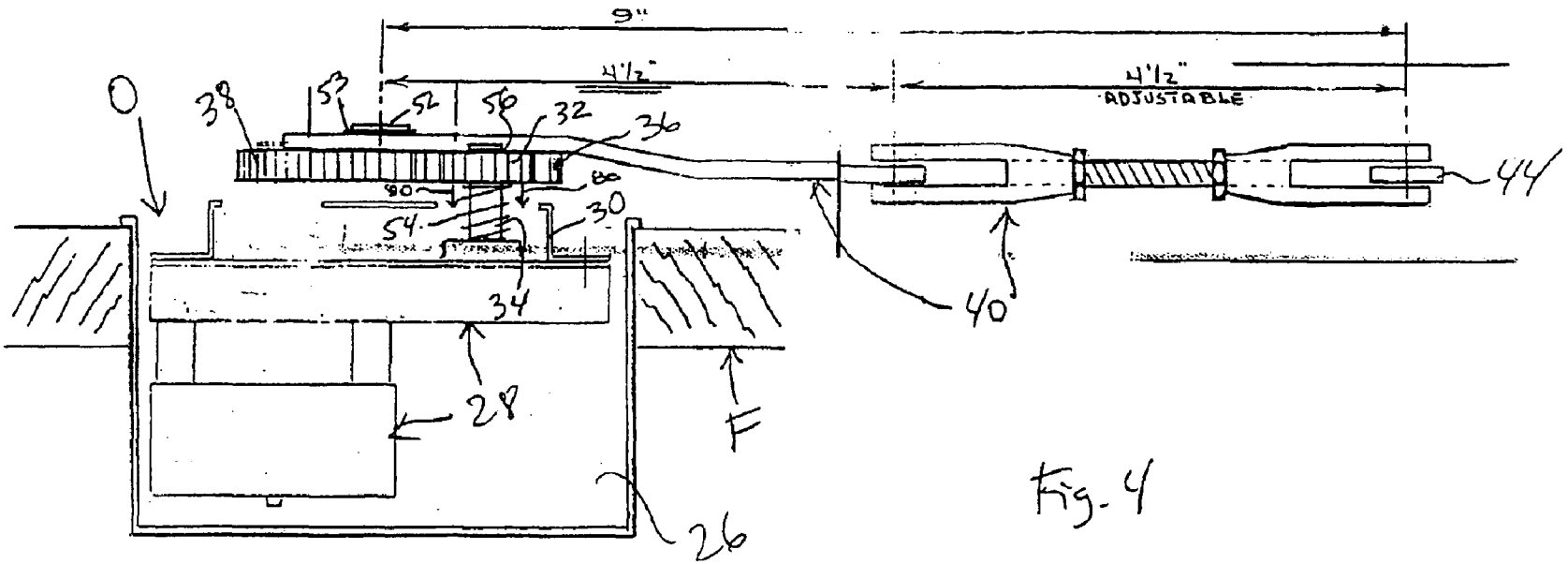
FIG. 4 is a schematic, broken away, front elevational view of FIG. 3.
Figure 5:
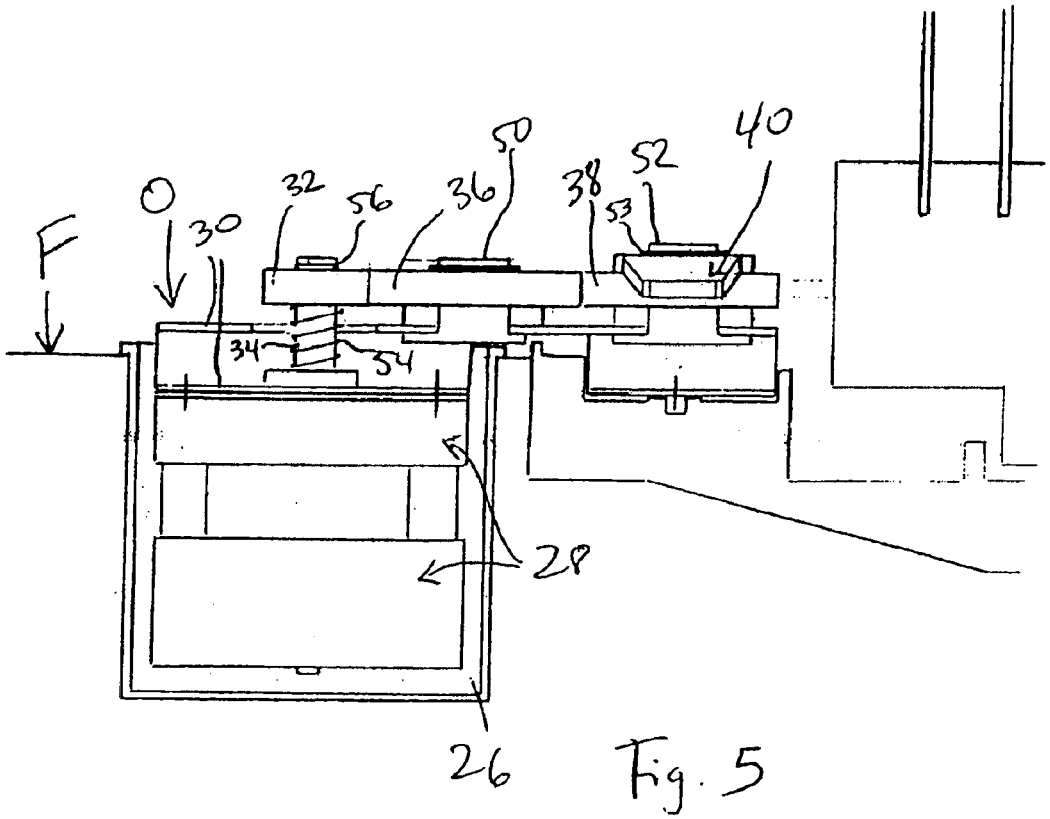
FIG. 5 is a schematic, broken away, side elevational view of the motorized operator installed in the casement window.

Now turning to the motorized operator O itself, it is adapted to be installed in a conventional recessed chamber 26 (see FIG. 4) defined in the lower horizontal section of the frame F. The operator O comprises a motor and its casing 28 which are of small dimensions (for instance, 4"×2¼"×2¼") with the motor 28 being capable of rotation in opposite directions for opening and closing the window W. As also seen in FIG. 2, the operator O comprises a base plate 30 which is typically made of metal and which is carefully adjusted to the profile of the metallic support frame provided in the general window frame F. The base plate 30 acts as a support for the motor and casing 28 located in the recessed chamber 26 defined in the wooden framing of the frame F. For example, the recessed chamber may measure 4⅜"×2⅜"×2¾".

A small first gear 32 (¾" in diameter) is mounted on a transmission motor shaft 34 of the motor 28. This first gear 32 transmits the rotation imparted thereto by the motor shaft 34 to a second gear 36 (1½" in diameter) which itself meshes with a third gear 38 (2" in diameter). A composite movement arm 40 is mounted at one end thereof to the third gear 38 using screws 41, whereas the other end of the arm 40 is attached to a frame 42 (see FIG. 1) of the window W by way of a bracket 44 and a pivot pin (not shown). The controlled rotational movement of the third gear 38 causes a pivot of the window W thereby opening or closing the same.

The motorized operator O also comprises first and second miniature lever switches 46 and 48, respectively. The first switch 46 is actuated by a pin which protrudes from under the second gear 36 and which is adapted to interrupt power to the motor 28 once the window W has reached its completely open position. Therefore, this pin is adjusted on the second gear 36 such that after a given rotation of the second gear 36, the pin actuates the first switch 46 and interrupts power to the motor 28, thereby preventing any attempt to further open the window W.

The second switch 48 is actuated by a further pin which protrudes under the third gear 38 and which is adapted to interrupt power to the motor 28 once the window W has reached its completely closed position. In a way similar to the pin mounted to the second gear 36, the pin mounted to the third year 38 is positioned such that after a given rotation of the third gear 38, its pin actuates the second switch 48 and prevents any attempt to further close the window W. Once the second switch 48 has been tripped by the pin provided under the third gear 38, the window W is completely closed whereby the catches 12 can be lowered to lock the window W to the frame F thereby simultaneously interrupting power to the motorized operator O and, more particularly, to the motor 28 for preventing any subsequent attempt to open the window W by way of the motorized operator without having previously unlocked the window W from the frame F by disengaging the catches 12 from the hooks 14.

Short first and second shafts 50 and 52, respectively are fixably mounted to the base plate 30 and constitute fixed pivots around which the second and third gears 36 and 38 can respectively rotate. Typically, the first and second shafts 50 and 52 are spot-welded to the base plate 30. Accordingly, the second and third gears 36 and 38 are free to rotate around these first and second shafts 50 and 52 while being prevented from being upwardly removed by circlips.

In order to allow for the window W to be manually opened or closed in the event, for instance, of a power failure, the motorized operator O is provided with a disengagement mechanism which includes a spring 54 which is positioned around the motor shaft 34 driven by the motor 28, this motor shaft 34 having herein a square shape with the opening in the first gear 32 being also square-shaped such that it rotates with the motor shaft 34. This configuration further allows the first gear 32 to slide along the motor shaft 34. The spring 54 is under compression under the first gear 32 and a circlip 56 is fixedly mounted around the motor shaft 34, above the first gear 32. Therefore, in a normal position, the spring 54 urges the first gear 32 upwardly against the circlip 56 and, in this position, the first gear 32 is disposed horizontally opposite the second gear 36 and is thus in meshed engagement therewith such that operation of the motor 28 causes the rotation of the first gear 32 by way of the motor shaft 34 and, in turn, the rotation of the second and third gears 36 and 38, respectively, and the displacement of the arm 40 and of the window W.

If it becomes necessary to disengage the motor 28 from the arm 40 for allowing the window W to be opened or closed manually (again in the event of a power failure), one must first remove a small cap provided on a decorative cover 58 (see FIG. 1) which conceals the motorized operator O. Then, a manual operator 60 can be used to manually open or close the window W. More particularly, the manual operator 60 comprises an elongated handle 62 defining, for instance, an hexagonal opening 64 at one end thereof, and a manual actuator 66 which is comprised of an upper cylindrical member 68 defining an upper hexagonal head 70 engageable through the hexagonal opening 64 of the handle 62 and a lower gear 72 which is mounted to the upper member 68 by way of its upper cylindrical section 73.

Once the aforementioned cap has been removed from the cover 58, the lower gear 72 of the manual operator 60 is introduced in the opening defined in the cover 58 and revealed by the removal of the cap. By doing so, the lower gear 72 will be aligned with the motor shaft 34 and, once the lower gear 72 becomes located around the upper end of the motor shaft 34, a further lowering of the lower gear 72 along the motor shaft 34 will force the first gear 32 downwardly along the motor shaft 34 (as per arrows 80 in FIG. 4), against the spring force of spring 54, thereby causing the unmeshing of the first gear 32 with the second gear 36. At the end of the downward travel of the lower gear 72, it lies horizontally opposite the second year 36 and, as the lower gear 72 is of similar dimensions to the first gear 32, the lower gear 72 in that position meshes with the second gear 36. As the lower gear 72 defines an inner opening such that it will be able to freely rotate around the motor shaft 34, once the lower gear 72 meshes with the second gear, the motor shaft 34 is in fact disconnected from the second gear 36 and, in other words, the second and third gears 36 and 38 and the arm 40 are all disconnected from the motor 28.

Furthermore, the upper member 68 of the manual actuator 66 includes an incorporated magnet (not shown) which is adapted to contact the upper end of the motor shaft 34 with the magnet force holding the manual actuator 66 and the motor shaft 34 together and compensating for the spring force of spring 54; in other words, the user does not need to continually press on the manual actuator 66 to keep its lower gear 72 in meshed engagement with the second gear 36 as the upward spring force of the spring 54 is compensated or overcome by the magnet force.

Then, the handle 62 is used to rotate the manual actuator 66 thereby causing its lower gear 72 to rotatably drive the second gear 36 and, in turn, the third gear 38 and the arm 40 for selectively opening or closing the window W. The manual actuator 66 can then be forced upwardly out of engagement with the motor shaft 34 and completely removed from the operator O before the aforementioned cap is repositioned onto the cover 58. Once power has been reinstated, the window W can be operated normally, that is by way of the motorized operator O since, upon withdrawal of the manual actuator 66, the spring 54 forced the first gear upwardly 32 against the circlip 56 and thus into engagement with the second gear 36.

It is noted that arm 40 includes various components which can be adjusted (see, for instance, threaded rod 74 which threadably engages both yokes 76). The arm 40 is further adapted to be disconnected from the window W, for instance at either of the pinned ends of the two yokes 76, to allow for a more pronounced manual opening of the window W, i.e. up to 90 degrees, to facilitate the cleaning of both the inner and outer surfaces of the window W.

It is also possible to use a humidity sensor on the outside of the window W to automatically cause the actuation of the motorized operator O in the event that it starts raining such as to automatically close the window W.

The above motorized operator O and its associated hardware, namely the limit switch 10 and the switch assembly 18 can all be generally retro-fitted onto an existing casement window C in replacement of its conventional crank arm and associated mechanism linking it to the window W. It is noted that both the main limit switch 10 and the switch assembly 18 are substantially small and can be installed without altering significantly the appearance of the casement window C. It is also proposed to incorporate the switch assembly 18 to the cover 58 which itself blends very well with the molding of the frame F of the casement window C.

It is noted that the adjustment for the end travel of the window W when using the motorized operator O is provided by the aforementioned threaded rod 74 of the arm 40. Alternatively, there could be a means to make that adjustment at the level of the positions of the first and second switches 46 and 48 on the base plate 30. Furthermore, the third gear 36 may preferably be provided with stops (not shown) to prevent excess manual operation which could bend or break the first and second switches 46 and 48.

As mentioned hereinabove, although the switch assembly 18 is shown in FIG. 1 on one of the vertical moldings of the frame F, it is preferably incorporated to the cover 58 located on the lower horizontal molding of the frame F.

I claim:

1. A motorized operator for opening and closing a window sash relative to a window frame, comprising a motor mountable in a cavity defined in the window frame, an arm mechanism connectible to the window sash, a drive axle adapted to be rotated by said motor, gear means adapted to be rotatably driven by said drive axle and to so cause the arm mechanism to pivot upon rotation of said gear means for opening and closing the window sash relative to the window frame, and a manual operator displaceable between an inoperational position and an operational positions in which said manual actuator is drivingly connected to the arm mechanism for opening and closing the window sash; said gear means being manually displaceable between first and second positions, wherein in said first position, said gear means is rotated by said motor via said drive axle for pivoting the arm mechanism and displacing the window sash, whereas in said second position, at least part of said gear means is mechanically disconnected from said drive axle such that said part of said gear means is not rotated by said motor, said part of said gear means being connected to said arm mechanism, whereby with said manual operator in said operational position, said manual operator is adapted to rotate said part of said gear means for causing the arm mechanism to pivot.

2. A motorized operator as defined in claim 1, wherein said gear means comprise first and second gears, said first gear being mounted on said drive axle for being rotatably driven thereby, said second gear being adapted to be mounted to the arm mechanism for causing the arm mechanism to pivot and being adapted to mesh, in said first position, with said first gear for being rotated thereby and causing the arm mechanism to pivot upon rotation of said drive axle by said motor.

3. A motorized operator as defined in claim 2, wherein said part of said gear means comprises said first gear such that, when said manual operator is in said operational position, said first gear is disengaged from said second gear with said manual operator being adapted to displace the arm mechanism.

4. A motorized operator as defined in claim 3, wherein, in said operational position, said manual operator meshes with said second gear for selectively rotatably driving said second gear and so causing the arm mechanism to pivot.

5. A motorized operator as defined in claim 4, wherein said first gear is selectively displaceable along said drive axle between functional and idle positions, wherein in said functional position, said gear means is in said first position for motorized operation of the arm mechanism, whereas in said idle position, said gear means is in said second position for manual operation of the arm mechanism.

6. A motorized operator as defined in claim 5, wherein by displacing said manual operator between said inoperational and operational positions thereof, said first gear is displaced between said functional and idle positions thereof, respectively.

7. A motorized operator as defined in claim 6, wherein said manual operator comprises a handle and a manual actuator, said manual actuator comprising a sprocket adapted to engage said second gear in said operational position such that rotation of said manual actuator by way of said handle causes rotation of said sprocket and of said second gear and thus also a pivot of the arm mechanism.

8. A motorized operator as defined in claim 7, wherein said manual actuator defines a central opening and is adapted, when said manual operator is displaced from said inoperational position to said operational position, to be displaced along said drive axle thereby causing said first gear to translationally slide along said drive axle out of engagement with said second gear, until said sprocket meshes with said second gear for manual operation thereof.

9. A motorized operator as defined in claim 8, wherein said drive axle rotates freely within said opening when said manual operator is in said operational position.

10. A motorized operator as defined in claim 9, wherein said first gear defines a central polygonal hole shaped substantially as a cross-section of said drive axle with said opening in said manual actuator being circular and having a diameter greater than a maximum transverse dimension of said drive axle.

11. A motorized operator as defined in claim 9, wherein said first gear is biased towards said functional position such that when said manual operator is displaced from said operational position to said inoperational position thereof, said first gear displaces from said idle position to said functional position thereof.

12. A motorized operator as defined in claim 11, wherein a spring is provided for urging said first gear to said functional position.

13. A motorized operator as defined in claim 2, wherein said second gear comprises first and second sub-gears in meshed engagement, said second sub-gear being mounted to the arm mechanism with said first sub-gear being adapted to mesh with said first gear in said first position and with said manual operator in said second position.

14. A motorized operator as defined in claim 1, wherein said manual operator is a separate component located remotely from said gear means in said inoperational position thereof.

15. A motorized operator as defined in claim 1, wherein said drive axle is adapted to be rotated in opposite directions by said motor, an operation of said motor being controlled by a manual switch adapted to be positioned at a visible location adjacent the window sash.

16. A motorized operator as defined in claim 1, wherein limit switches are provided for interrupting a rotation of said motor at pre-selected limit positions of the window sash relative to the window frame.

17. A motorized operator as defined in claim 1, in combination with a composite arm adapted to be mounted to the window sash, said composite arm being manually adjustable in length.

18. A motorized operator as defined in claim 1, wherein a switch is provided on each locking mechanism of the window sash to the window frame for preventing operation of said motor if any of these locking mechanisms is in a sash locking position thereof.

* * * * *